United States Patent [19]

Chelin

[11] 4,056,170

[45] Nov. 1, 1977

[54] LOAD FORCE BYPASSING APPARATUS FOR LIFT TRUCK MASTS

[75] Inventor: Charles R. Chelin, Peoria, Ill.

[73] Assignee: Towmotor Corporation, Mentor, Ohio

[21] Appl. No.: 733,645

[22] Filed: Oct. 18, 1976

[51] Int. Cl.[2] ..... B66B 7/02; B66F 9/12

[52] U.S. Cl. ..... 187/95; 187/9 R; 308/3 R

[58] Field of Search ..... 187/9 R, 9 E, 95; 214/655, 660, 670–674; 308/3 R, 3 A, 3 B

[56] References Cited

U.S. PATENT DOCUMENTS

| | | | |
|---|---|---|---|
| 2,321,029 | 6/1943 | Johnson | 187/95 X |
| 3,070,190 | 12/1962 | Rogers et al. | 187/95 |
| 3,083,853 | 4/1963 | Hastings | 214/660 |
| 3,572,516 | 3/1971 | Suez | 187/9 E X |

*Primary Examiner*—Evon C. Blunk
*Assistant Examiner*—James L. Rowland
*Attorney, Agent, or Firm*—Frank L. Hart

[57] ABSTRACT

A load force bypassing apparatus is provided for a work engaging support assembly, such as a lift truck fork and mast assembly, having a plurality of rollers movably mounting a carriage assembly on a generally upright support with the rollers normally subjected to load forces imparted against the carriage assembly during a normal load crowding operation. The bypassing apparatus is positioned between the carriage assembly and the upright support in direct force transmitting relation to effectively isolate the rollers from the load forces during the normal load crowding operation.

8 Claims, 4 Drawing Figures

LOAD FORCE BYPASSING APPARATUS FOR LIFT TRUCK MASTS

BACKGROUND OF THE INVENTION

The present invention is related to a load force bypassing means for a lift truck fork and mast assembly. The bypassing means is disposed between a work engaging fork and carriage assembly having rollers and a generally upright support mast in direct force transmitting relation to effectively isolate the rollers mounting the carriage on the upright support mast from the load forces encountered during normal load crowding operations.

A standard lift truck arrangement has the carriage movably mounted on the upright support mast by sets of carriage rollers which transfer load carried by the forks to the upright support mast. Normal crowding or forcible engagement of the forks with the load produces particularly high forces which are normally transmitted by the rollers to the upright support mast causing damage and early failure of these components.

Load crowding is the act of loading the lift forks by forcibly engaging the forks with the load while using the lift truck to push the forks under the load. It is normally performed with the carriage and forks raised slightly a few inches to prevent the forks from dragging on debris or the earth. Dragging forks impede the motion of the lift truck. It is normal practice in logging applications to use full tractive effort to crowd the load against the forks while tilting the fork and mast assembly backwards to lift the load. This subjects the carriage rollers to impact loading due to the tractive effort of the lift truck. Standard lift truck arrangements are plagued by damage to the rollers and upright support mast in this type of operation.

Uneven loading of the forks in logging applications is also a problem with standard lift trucks. Uneven loading occurs because of uneven fork contact with irregularly shaped logs. This causes misalignment of the sets of carriage rollers with respect to the upright support mast which accelerates wear.

The present invention improves upon the general features of the lift truck mast by isolating the carriage rollers from the load forces encountered during normal load crowding operations.

SUMMARY AND OBJECTS OF THE INVENTION

The present invention resides in a load force bypassing apparatus for a lift truck mast. Such bypassing apparatus is disposed between a work engaging fork and carriage assembly having rollers and an upright support mast in direct force transmitting relation to effectively isolate the rollers from load forces encountered during normal load crowding operations.

It is an object of the present invention to provide a bypassing apparatus which isolates the rollers and prevents force transmission by the rollers during normal load crowding operations.

Another object of the present invention is to provide a force bypassing apparatus which passes load forces imposed against the carriage during normal load crowding operations directly to the upright support mast.

Another object of the present invention is to provide a force bypassing apparatus which diminishes the effects of uneven loading during normal load crowding operation.

These and other objects and advantages of the present invention will become more readily apparent upon reference to the accompanying drawings and following description.

DESCRIPTION OF THE PREFERRED EMBODIMENT

Figure 1:
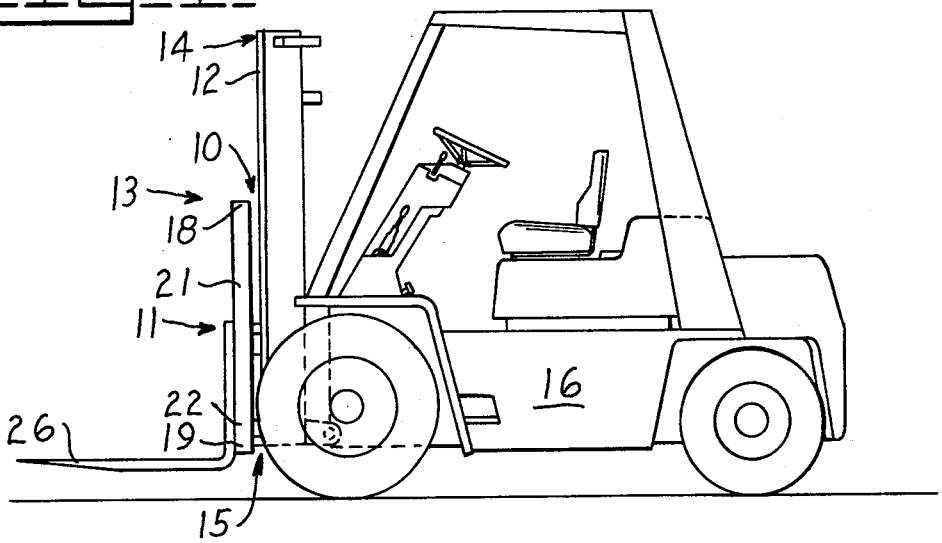
FIG. 1 is a side view of a lift truck showing a lift mast incorporating the present invention.

Referring to FIG. 1, a load force bypassing apparatus 10 is disposed between a work engaging fork and carriage assembly 11 and a pair of generally upright channular support beams 12 of a lift mast 13 having upper and lower end portions 14 and 15. The lower end portion pivotally connects the lift mast to a lift truck 16.

Figure 2:
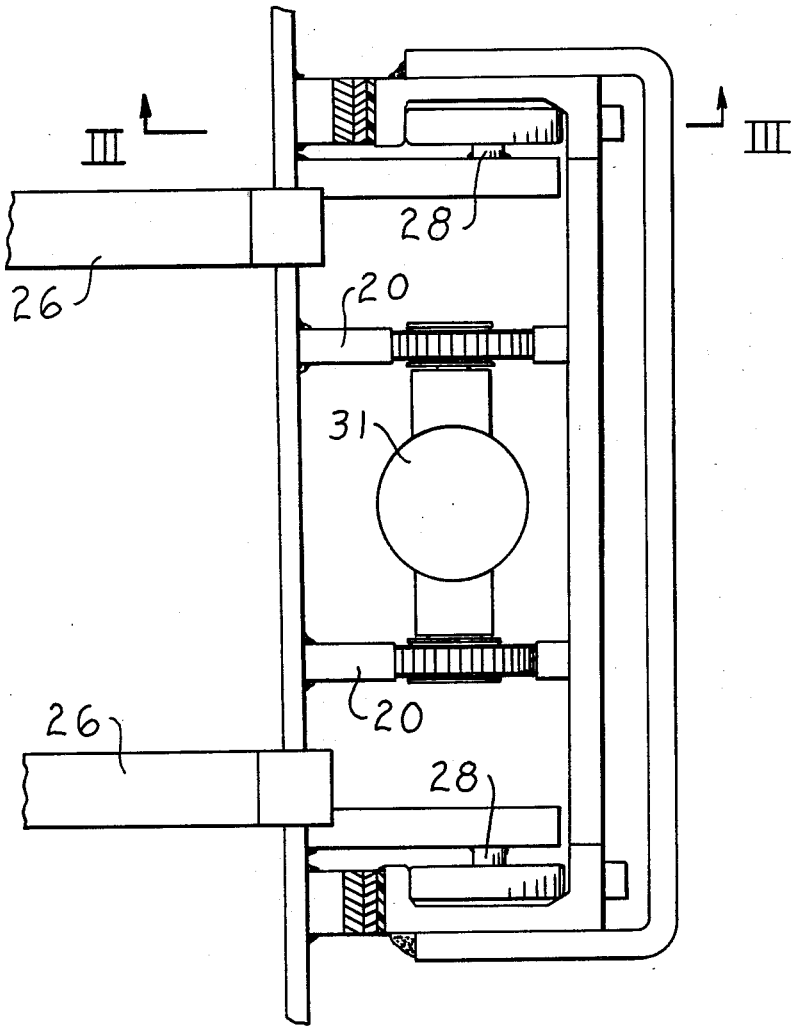
FIG. 2 is a somewhat enlarged plan view of the lift mast.
Figure 3:
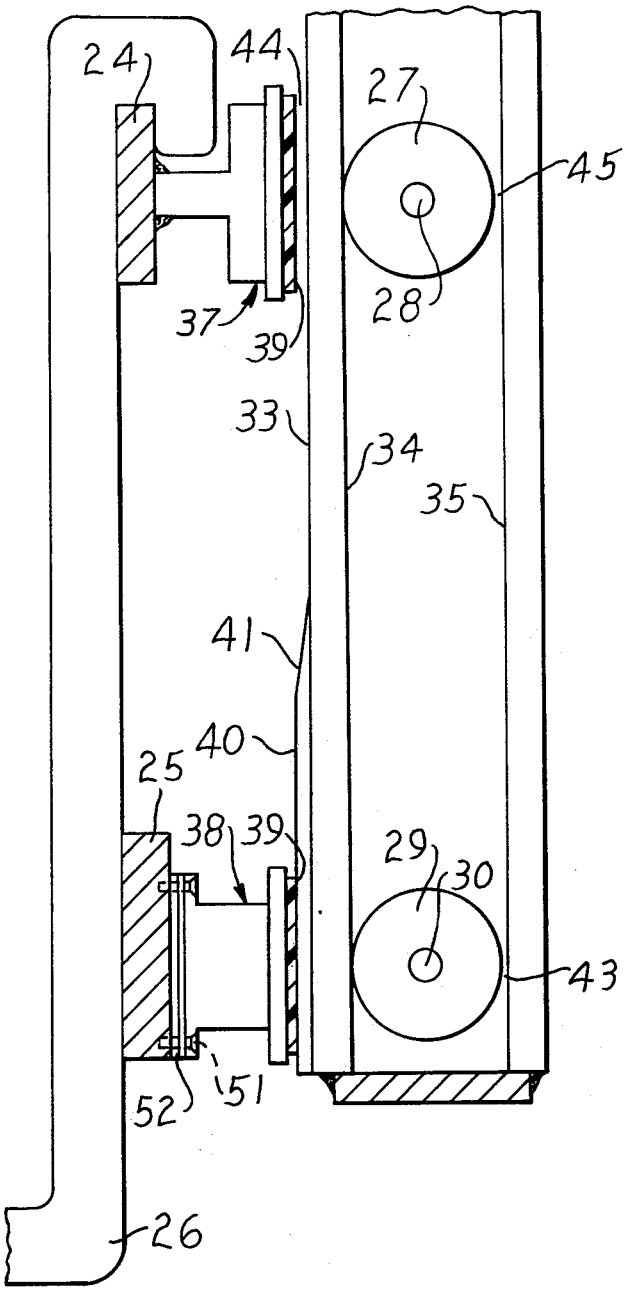
FIG. 3 is a transverse vertical section through the lift mast taken generally along the line III—III of FIG. 2.

Referring now to FIGS. 2 and 3, the fork and carriage assembly 11 has an upper end portion 18, a lower end portion 19, and a frame 20 having upper and lower members 21 and 22, respectively. The carriage includes an upper cross brace 24 and a lower cross brace 25 connected to the upper and lower carriage frame members, respectively. A pair of lift forks 26 are supported by the upper and lower cross braces. The carriage further includes a pair of upper rollers 27 connected to the upper frame member by a pair of upper roller supports 28 and a pair of lower rollers 29 connected to the lower frame member by a pair of lower roller supports 30. The fork and carriage assembly is raised and lowered by a hydraulic lifting mechanism 31.

The generally upright channular support beams 12 individually provide an outer front contacting surface 33, a front inner flange surface 34 and a rear inner flange surface 35. The upper rollers 27 rollingly contact the front inner flange surface and the lower rollers 29 rollingly contact the rear inner flange surface to support the fork and carriage assembly 11 when it is raised or lowered during operation.

The load force bypassing apparatus 10 includes a pair of upper crowding blocks 37 connected to the upper cross brace 24 and a pair of lower crowding blocks 38 connected to the lower cross brace 25. A bearing surface 39 is provided on each of the crowding blocks. An engagement strip 40 having a ramp 41 is connected, as by welding or the like, to the outer front surface 33 of each of the channular support beams 12. The bearing surface of each of the upper crowding blocks is positioned for sliding engagement with the respective outer front surfaces of the support beams. The bearing surfaces of the lower blocks are positioned in abutting relation to their respectively adjacent engagement strips for sliding engagement therewith. The engagement strip length is determined by the height to which the fork and carriage assembly 11 is raised during normal load crowding operations. This strip length is substantially shorter than the length of total fork and carriage assembly travel.

The lower blocks 38 and their respectively adjacent engagement strips 40 abut to maintain a space 43 between the lower rollers 29 and their respective rear inner flange surfaces 35 while preventing loading of the lower rollers against the front inner flange surfaces 34. There is a space 44 between the upper blocks 37 and their respective outer front surfaces 33 which is less than a space 45 between the upper rollers 27 and their respective rear inner flange surfaces 35. These spaces prevent force transmission by the upper and lower rollers during normal load crowding operations by preventing the formation of a force transmission path through the rollers.

OPERATION OF THE PREFERRED EMBODIMENT

While the operation of the preferred embodiment of the present invention is believed clearly apparent from the foregoing description, further amplification will subsequently be made in the following brief summary of such operation.

During normal load crowding operations, the lift truck 16 pushes the forks 26 into a load which imparts load forces against the carriage frame 20. This translates motion to the frame which forces the upper and lower rollers 27 and 29 toward the rear inner flange surfaces 35 of each of the upright channular support beams 12. When the forces are of sufficient magnitude, the rollers are jammed against the rear flange surface, causing stresses of high magnitude to be placed on these components. This results in premature failure of the rollers and uneven wear of the rear flange surfaces.

With the present invention, motion of the carriage frame 20 forces the upper rollers 27 and upper crowding blocks 37 towards the rear flange surfaces 35. The space 44 between the upper blocks and their respective outer front surfaces 33 is less than the space 45 between the upper rollers and their respective rear flange surfaces, and the lower blocks 38 abut the engagement strip 40 to maintain the space 43 between the lower rollers 29 and their respective rear flange surfaces. Because of this spacing arrangement, the crowding blocks contact the outer front surface and strip before the rollers contact the rear flange surface. This establishes a force transmission path which passes forces directly from the carriage 11 to the upright channular support beams 12 while isolating the rollers from the forces. Constant contact between the lower blocks and their respective engagement strips maintains the space between the lower rollers and their respective rear flange surfaces which isolates the lower rollers during normal load crowding operations.

After crowding, the carriage frame 20 is raised to slide the lower blocks 38 along the strip ramps 41 until the lower rollers 29 support the load by contacting the rear flange surfaces 35. The lower rollers generally contact the rear flange surfaces when the upper rollers 27 contact the front inner flange surfaces 34, then operation is substantially the same as with conventional lift trucks. Conventional operation continues when the carriage frame is lowered until the lower blocks slide along the strip ramps onto the strips 40. At this point the carriage frame slides the remaining short distance because the rollers are out of rolling contact with the inner flange surfaces. This is a noted improvement over conventional arrangements which have the rollers contacting the flange surfaces at all times during the carriage frame ascent and descent which forces the rollers to move over the flange surfaces which have been damaged from load crowding operations.

The present invention also minimizes the effects of uneven loading during crowding caused by uneven engagement of the lift forks 26 with the load. Uneven loading pushes one fork more than the other and consequently translates more motion to one side of the carriage frame 20 than the other. This jams some of the upper and lower rollers 27 and 29 into the rear inner flange surfaces 35 with more force than others and misaligns the rollers. The present invention solves this problem by using the crowding blocks 37 and 38 and strips 40 to restrict one-sided motion of the carriage frame and prevent damaging contact between the rollers and the rear inner flange surfaces.

In view of the foregoing, it is readily apparent that the preferred embodiment of the present invention provides an improved means for transmitting load forces. The bypassing apparatus 10 disposed between the fork and carriage assembly 11 and upright support beams 12 of a lift mast 13 in direct force transmitting relation therebetween effectively isolates the upper and lower carriage rollers 27 and 29 from the forces. The objects of the present invention as set forth in the beginning of the specification have been accomplished through the preferred embodiment of the present invention. There are, however, alternate embodiments of the present invention which accomplish these objects.

ALTERNATE EMBODIMENT

Figure 4:
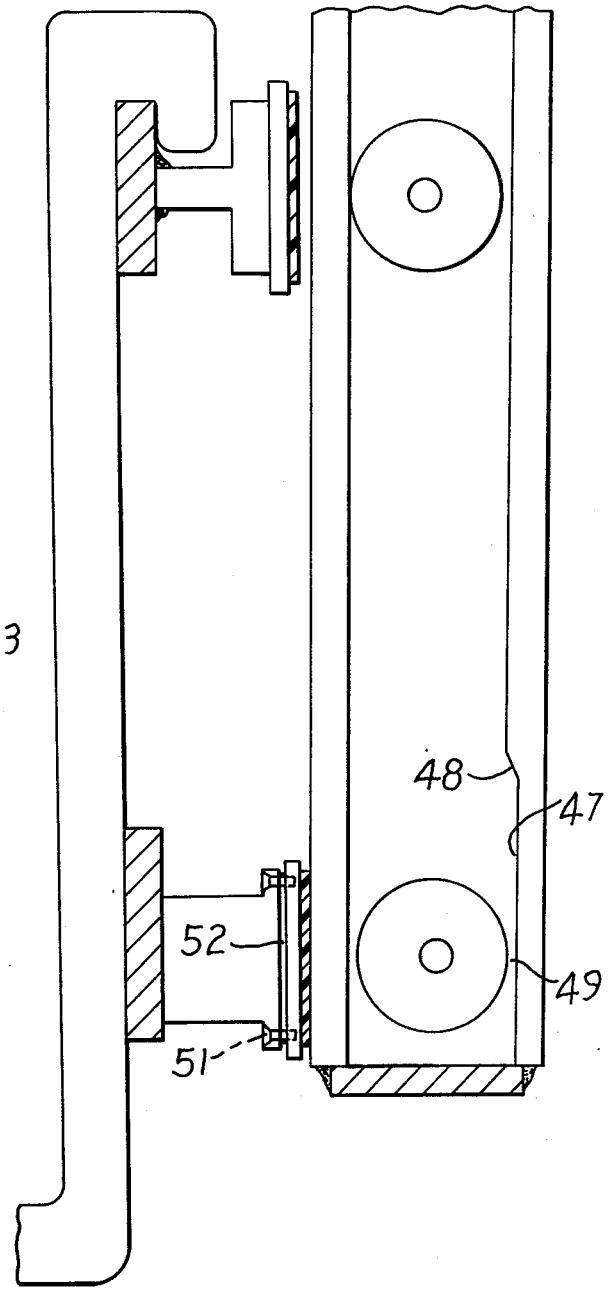
FIG. 4 is a sectional view through the lift mast similar to FIG. 3 but showing an alternate embodiment of the present invention.

An alternate embodiment of the present invention which differs only slightly from the preferred embodiment is shown in FIG. 4. The difference is that an elongated support beam indentation 47 replaces the engagement strip 40 for each upright channular support beam 12 (FIG. 3). The support beam indentation has a ramp 48 and substantially the same length as the strip it replaces. The indentations have a depth sufficient for maintaining a space 49 between the lower rollers 29 and their respective indentations without loading the lower rollers against the front inner flange surfaces 34 when the lower blocks 38 are in their normal position abutting their respective front flange surfaces.

Operation with the support beam indentation 47 replacing the engagement strip 40 is essentially unchanged during crowding. When crowding is completed and the carriage frame 20 is raised, the lower blocks 38 slide along the outer front contacting surface 33 until the lower rollers 29 engage the indentation ramps 48 to contact the rear flange surfaces 35. As the lower rollers ride upon the ramp, the lower blocks are separated from contact with the outer front surfaces. As the carriage frame is lowered, the lower blocks contact the front surfaces as the lower rollers descend the ramps.

Many lift trucks feature a multi-stage mast having one or more pairs of intermediate channular support beams (not shown) nested between the generally upright channular support beams 12. Where there is a multi-stage mast in which the upper and lower carriage rollers 27 and 29 do not contact the rear flange surfaces 35 of the upright support beams but contacts the intermediate support beams, then the support beam indentation 47 would be located in the intermediate support beam on which the carriage rollers ride. This prevents the carriage rollers from jamming against the intermediate and upright support beams during load crowding.

Referring to FIG. 3, another feature of the present invention is shown providing a removable fastening device 51, such as a machine screw assembly or the like, and a positioning shim 52 adjustably mounting each of the crowding blocks 37 and 38. The shims are positioned between the blocks and their respective cross braces 24 and 25. The spaces 44 between the upper blocks and outer front surfaces and the spaces 43 between the lower rollers and rear flange surfaces can be adjusted for varying conditions. Another method of adjusting the spaces is shown in FIG. 4 where the fastening device and the shim adjustably connect the bearing surfaces 39 to the crowding blocks. With this method the blocks can be welded or bolted to the braces and the bearing surfaces can be replaced when worn or when it is otherwise desirable to do so. For instance, it may be desirable in certain operations to change from ferrous bearing surfaces to corrosion resistant ultra high molecular weight (UHMW) plastic bearing surfaces for improved service.

SUMMARY OF THE DESCRIPTION

In view of the foregoing, it is readily apparent that the structure of the present invention provides an improved apparatus for transmitting load forces so that these forces bypass the carriage rollers. The objects of the present invention as set forth in the beginning of the specification have been accomplished through the described embodiments of the present invention. While the invention has been described and shown with particular reference to the described embodiments, it will be apparent that variations might be possible that would fall within the scope of the present invention which is not intended to be limited, except as defined in the following claims.

What is claimed is:

1. In a mast arrangement including a generally upright support, a work engaging assembly, a plurality of rollers movably mounting the assembly on said generally upright support, said rollers normally being subjected to load forces imparted against said assembly during normal load crowding operations, the improvement comprising;

load force bypassing means for maintaining said rollers substantially free of loading due to said load forces, said bypassing means being positioned between said assembly and said support in direct force transmitting relation therebetween to thereby directly pass said load forces from said assembly to said support only when said assembly is below a preselected height of said support.

2. Apparatus as set forth in claim 1, wherein the load force bypassing means comprises;

at least one crowding block disposed between the work engaging assembly and the generally upright support;

a bearing surface on said crowding block; and at least one engagement strip being disposed between the work engaging assembly and the generally upright support in opposed relation to said bearing surface of the crowding block for slidable engagement therewith.

3. Apparatus as set forth in claim 2, wherein the load force bypassing means comprises;

a plurality of upper and lower crowding blocks connected to said work engaging assembly;

a bearing surface on said crowding blocks, and a plurality of engagement strips being connected to the generally upright support and disposed in opposed relation to said lower crowding blocks only for slidable engagement therewith.

4. In a work vehicle lift mast having at least one generally upright support, a carriage assembly with upper and lower end portions, and a plurality of rollers movably mounting the carriage on said support, said rollers normally being subjected to load forces imparted against said carriage during normal load crowding operations, the improvement comprising;

a plurality of upper and lower crowding blocks connected to said carriage assembly respectively adjacent to said upper and lower end portions thereof, said blocks having bearing surfaces and being disposed between said carriage and said upright support in direct force transmitting relation therebetween to effectively isolate said rollers from said load forces; and a plurality of engagement strips connected to said support and being positioned in opposed relation to said lower crowding blocks only for slidable engagement therewith.

5. Apparatus as set forth in claim 1, wherein the load force bypassing means comprises;

at least one crowding block having means for connection to the work engaging assembly;

a bearing surface on said crowding block; and said upright support having at least one indentation, said indentation being positioned opposed to said rollers in spaced relation thereto and being positioned below a preselected height of said upright support.

6. Apparatus as set forth in claim 2, including removable connection means for adjustably mounting said crowding block to said work engaging assembly; and at least one shim associated with said crowding block for variably positioning said bearing surface thereof with relation to said generally upright support for a slidable engagement therewith.

7. A load force bypassing apparatus, for a work vehicle lift mast having upper and lower end portions and a pair of generally upright spaced channular members providing predetermined front and rear inner flange surfaces and outer front surfaces, a carriage assembly having upper and lower end portions, and a plurality of rollers rollably engaging said inner flange surfaces for movably mounting the carriage on said channular members, said rollers and said inner flange surfaces normally being subjected to load forces imposed against said carriage during normal load crowding operations, comprising;

a plurality of engagement strips being connected to said outer front surfaces of said channular members adjacent to the lower end portion of the lift mast;

and a plurality of upper and lower crowding blocks connected to said carriage assembly respectively adjacent to said upper and lower end portions thereof, said blocks having a bearing surface disposed for sliding engagement against said outer front surfaces and said engagement strips with said upper blocks being disposed in predetermined spaced relation to said outer front surfaces of said channular members and said lower blocks being disposed in contacting sliding engagement with the engagement strips in direct force transmitting relation to effectively isolate said rollers from said load forces during the imposition of said load forces against the carriage assembly.

8. The load force bypassing apparatus of claim 7 in which said upper rollers are normally spaced a distance from said rear inner flange surfaces greater than the spacing of said bearing surfaces of the upper blocks with respect to the outer front surfaces of said channular members.

* * * * *